United States Patent [19]

Griggs

[11] 4,079,722

[45] Mar. 21, 1978

[54] ARCHERY BOW WITH ADJUSTABLE LOOP TO CLEAT CONNECTIONS ON BOW STRING SECTIONS

[75] Inventor: Lonnie P. Griggs, Jacksonville, Tex.

[73] Assignee: AMF Incorporated, White Plains, N.Y.

[21] Appl. No.: 734,163

[22] Filed: Oct. 20, 1976

[51] Int. Cl.[2] ..... F41B 5/00

[52] U.S. Cl. ..... 124/24 R; 124/90

[58] Field of Search ..... 124/24 R, 23 R, 86, 124/88, 90; 403/291; 24/115 H, 115 K, 20 EE, 265 HE, 265 AL; 182/150, 3-7

[56] References Cited

U.S. PATENT DOCUMENTS

| | | | |
|---|---|---|---|
| 3,802,411 | 4/1974 | Manspeaker | 124/90 |
| 3,945,368 | 3/1976 | Jones | 124/24 R |
| 3,967,609 | 7/1976 | Frydenlund | 124/24 R |
| 4,005,696 | 2/1977 | Jennings | 124/24 R |

OTHER PUBLICATIONS

"Sidekick", Jennings Compound Bow Inc.—Archery Magazine—Aug. 1976, p. 29.

*Primary Examiner*—Harland S. Skogquist
*Assistant Examiner*—William R. Browne
*Attorney, Agent, or Firm*—George W. Price; Walter Lewis

[57] ABSTRACT

A compound archery bow having a central stretch of a bow string with loops at its opposite ends and is adjustably connected at its opposite ends to the opposite ends of the bow cable by being hooked onto any one of an integral series of cleats affixed to the opposite ends of the bow cable.

1 Claim, 5 Drawing Figures

ARCHERY BOW WITH ADJUSTABLE LOOP TO CLEAT CONNECTIONS ON BOW STRING SECTIONS

This invention relates to an improvement in compound bows, and more particularly, to means for making fine adjustments therein.

In the accompanying sheet of drawing.

Figure 1:
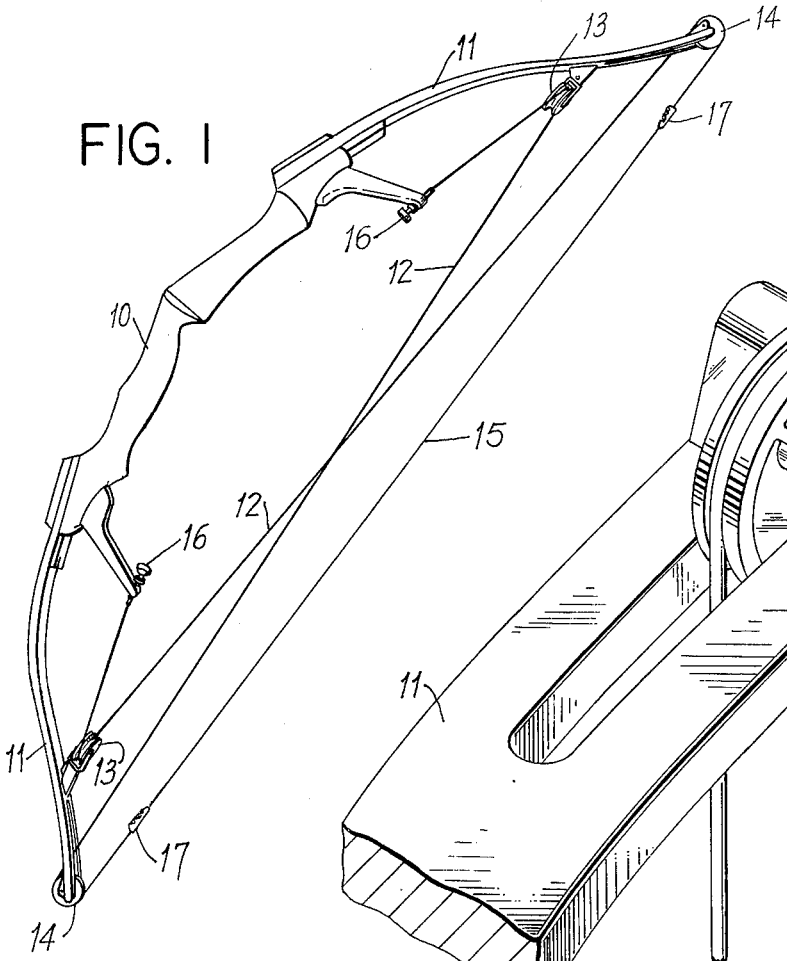
FIG. 1 is a perspective view of a compound bow incorporating the invention.

Referring now first to FIG. 1, illustrated therein is one well-known form of compound bow comprising a central handle 10, a pair of limbs 11, and bow stringing comprising two bow cable sections 12 strung over a pair of pulleys 13 and cam wheels 14 and a central stretch 15. As will be obvious to those skilled in the art, the inner ends of the stringing are anchored to the bow, and this can be adjustable, as at the means 16, the limbs 11 can be flexible and removably and/or adjustably connected to the handle 10, and the stringing 12 and 15 could be continuous instead of in three pieces as shown. However, in the invention the stringing is divided into the two cable sections 12 and the central bow string 15, and the bow string 15 is adjustably connected to the sections 12 by a pair of multi-position cleats 17, as best shown in FIG. 2.

Figure 2:
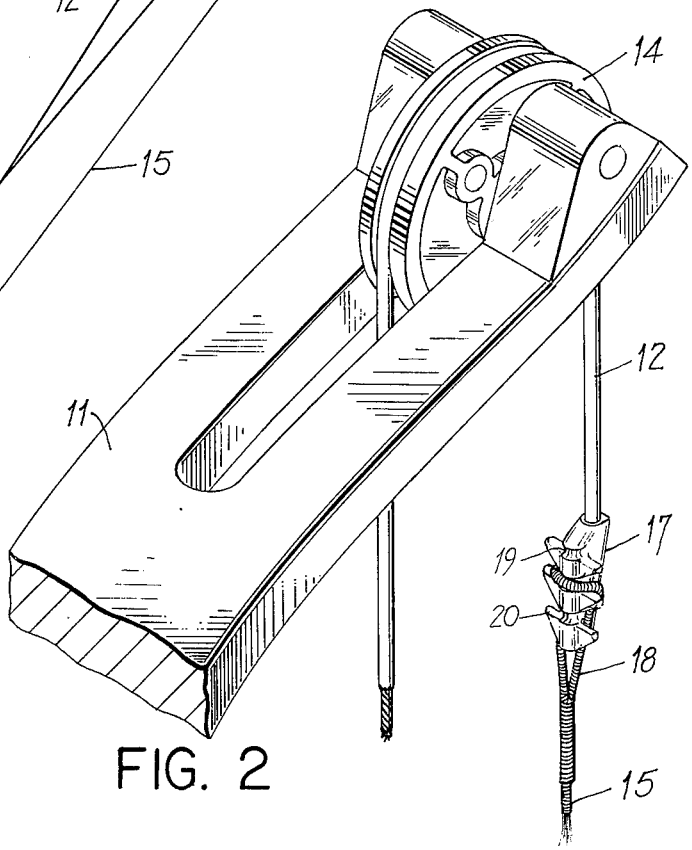
FIG. 2 is an enlarged perspective view of the upper end of the bow.

As seen in FIG. 2, the cleats 17 are anchored to the outer ends of the segments 12, and the central stretch or bow string 15 has loops 18 formed at the ends thereof for quick connection to the cleats 17. The cleats are multiple position cleats in that the loops 18 can be hooked on to the cleats in three different positions, although more or less than three positions could be provided.

Figure 3:
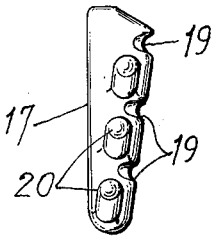
FIG. 3 is a side view of the adjustable cleat.
Figure 4:
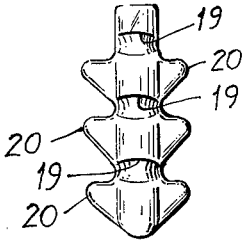
FIG. 4 is a front view of the cleat.
Figure 5:
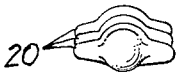
FIG. 5 is an end view of the cleat.

Referring now also to FIGS. 3–5, the cleats 17 are somewhat wedge-shaped when viewed from the side, see FIG. 3. Their back edges are straight, and three spaced grooves 19 are formed on their front edges. Three pairs of laterally extending ears or wings 20 are formed in the sides of the cleats adjacent to and just below the grooves 19. Thus, when the loops 18 are hooked on to the cleats, the loops 18 are positioned in any one of the grooves 19 and on that pair of ears just below the selected groove, in the manner illustrated in FIG. 2.

Thus, in the invention it is possible to make quick adjustments in the tension in the central stretch or bow string 15. That is to say, it is possible to make fine adjustments up or down in the weight of the bow without actually changing the setting of the limbs 11 with respect to the handle 10. Also, it is possible to quickly make adjustments for odd lengths in the central stretch 15.

In the illustrated embodiment of the invention when the loops 18 are positioned in and on the central groove 19 and ears 20, this is an average position, and when in and on the upper groove and ears, the position or setting is +2 pounds, and when in and on the lowermost groove and ears, the condition is −2 pounds. Thus, it will now be seen that the invention provides means for quickly and conveniently making fine adjustments in either direction, and although the invention is specifically illustrated with respect to a particular type of compound bow, the invention will find utility in other bow designs.

I claim:

1. In an archery bow comprising a central handle and a pair of limbs connected thereto and bow stringing extending between the opposite outer ends of said limbs, said bow stringing comprising end string sections extending towards each other from said limb ends and a central string section connected to said end sections, the improvement of multi-position cleats affixed to the free ends of said end string sections and string loops formed on the opposite ends of said central string section for adjustably hooking said central string section onto said end string sections, said cleats being elongated and anchored at one of their ends to the free ends of said end string sections, a series of spaced grooves formed on said cleats along the length thereof and a series of spaced pairs of opposite laterally extending ears also formed on said cleats along the length thereof, said grooves and pairs of ears being lengthwise alternated with each other, and said loops when hooked on said cleats being disposed in any one of said grooves and on the pair of ears immediately there below when viewed from the opposite end of the bow.

* * * * *